US005883655A

United States Patent [19]

Szlucha

[11] Patent Number: 5,883,655

[45] Date of Patent: Mar. 16, 1999

[54] COPY SHEET STACKING APPARATUS WITH ARTICULATED EXIT GUIDE RAMP

[75] Inventor: Thomas F. Szlucha, Fairport, N.Y.

[73] Assignee: Xerox Corporation, Stamford, Conn.

[21] Appl. No.: 711,177

[22] Filed: Sep. 9, 1996

[51] Int. Cl.[6] ..... B41J 2/01

[52] U.S. Cl. ..... 347/104

[58] Field of Search ..... 347/104, 102; 400/578, 624, 625, 628, 632, 632.1; 271/207, 182, 213, 189

[56] References Cited

U.S. PATENT DOCUMENTS

| | | | |
|---|---|---|---|
| Re. 32,572 | 1/1988 | Hawkins et al. | 137/68.19 |
| 4,571,599 | 2/1986 | Rezanka | 347/87 |
| 4,728,963 | 3/1988 | Rasmussen et al. | 346/25 |
| 5,455,604 | 10/1995 | Adams et al. | 346/138 |

FOREIGN PATENT DOCUMENTS

530821A2 9/1992 European Pat. Off. .

*Primary Examiner*—N. Le
*Assistant Examiner*—Michael Nghem

[57] ABSTRACT

A copy sheet collection station, in one embodiment as used in an ink jet printer, incorporates an exit guide ramp which prevents the sheets deposited into the output tray from being smeared by successively deposited sheets. The exit guide ramp comprises a sheet support surface balanced on a pivot edge, the position of the ramp on either side of the pivot point effectively forming an articulated ramp. A ramp segment on the print zone exit side of the printer has a greater mass than the remaining segment. As the copy sheet exits the print zone and moves along the surface of the ramp, it extends past the ramp edge in cantilevered fashion. At some point, the weight of the paper overcomes the mass of the print side ramp segment causing the ramp member to rotate clockwise, lowering the sheet to its final position in the output tray. Once the sheet clears the edge of the ramp, the ramp rotates back to its unloaded position.

7 Claims, 3 Drawing Sheets

COPY SHEET STACKING APPARATUS WITH ARTICULATED EXIT GUIDE RAMP

BACKGROUND OF THE INVENTION AND MATERIAL DISCLOSURE STATEMENT

The present invention relates to a copy sheet stacking apparatus, and, more particularly to a copy sheet stacking apparatus that controls a lead edge trajectory path of a sheet as it exits a print area in order to prevent the back of the exiting sheet from affecting the front of a previously deposited sheet whose recorded image may not be completely dry.

Commercial copiers and printers typically have two copy sheet stations, a first paper feed station for feeding copy sheets into a path which carries the sheet through an image recording station, and a second sheet station where the output prints carrying a recorded image are conveyed and deposited. A particular problem for printers which form images by depositing ink into the recording zone (e.g. thermal and piezoelectric ink jet printers) is the smearing of ink on a sheet previously deposited in an output tray by the sliding contact of the leading edge of the subsequently exiting sheet. If the printer output rate is slow enough, this may not be a problem. However, as output copy rates increase, the ink smearing problem becomes more significant. Various approaches to alleviating this smearing problem are known and practiced in commercial printers and in the prior art. HP Deskjet 500 ink jet printers incorporate a minimum time delay into the system before sheets are deposited by suspending the printed sheets on opposed support rails which are subsequently withdrawn to allow the sheet to fall onto a previously deposited sheet. This process, as disclosed in detail in U.S. Pat. No. 4,728,963, requires a relatively complex mechanism, which adds to the printer cost. Another alternative is to select a fast drying ink; however, such inks may not be the most appropriate ink for a particular printer design. A still further approach, which adds to the cost and complexity of the system, is the use of a heating device to dry the ink on the printed sheet.

SUMMARY OF THE INVENTION

It is therefore one object of the invention to prevent output sheet smearing while enabling usage of a wide variety of ink media.

It is a further object to provide a simple mechanical mechanism for depositing output sheets atop each other in an output station in such a way that the lead edge of the exiting sheet does not slide across the recorded image side of a previously deposited sheet.

These and other objects are realized by providing an articulated guide ramp having two segments, supported at a pivot point at the exit side of a recording station. The function of the ramp is to cantilever the exiting sheet out over a previously stacked sheet. As the exiting sheet moves along the ramp, the weight of the sheet at some predetermined point causes the ramp to rotate upon the pivot point, lowering the sheet into non-sliding contact with the top of the previously deposited sheet. The ramp, relieved of the weight of the existing sheet rotates upward and is restored to its original unloaded position to await the receipt of the next exiting sheet. More particularly, the invention relates to a copy sheet stacking apparatus for stacking sheets conveyed from a print station, comprising in combination: an articulated ramp member having a surface for supporting the copy sheet as it emerges from the print station, the surface having a length shorter than the copy sheet length so that the copy sheet is cantilevered past the end of the surface; a vertical member supporting said ramp member at a pivot point, wherein said member is pivotable about said vertical member; and an output tray; and wherein said ramp member has a weighted segment which provides a downward force W at one end of the ramp member which is overcome when the weight of the sheet supported by the ramp member surface exceeds W, causing the ramp member to rotate about the pivot point, lowering the sheet into the output tray.

DESCRIPTION OF THE INVENTION

Figure 1:
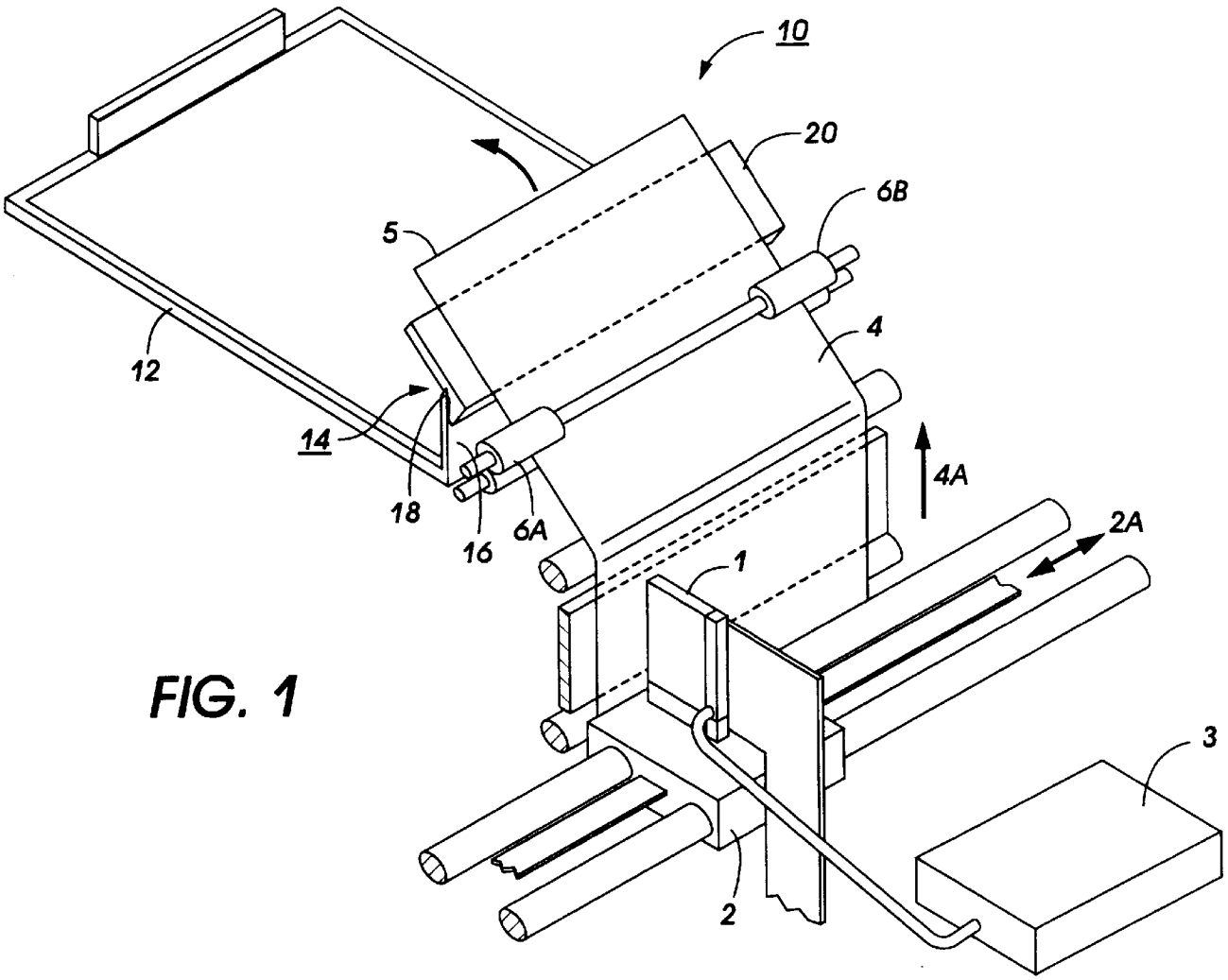
FIG. 1 is a front schematic view of an ink jet printer, incorporating the copy sheet stacking device of the invention.

A thermal ink jet printer is shown in FIG. 1, which incorporates the output sheet stacking apparatus of the present invention. The printer is exemplary only in that it is understood that the stacking apparatus could be used with other types of copiers or printers.

The printer shown in FIG. 1 has a printhead 1, mounted on a carriage 2, and connected to receive ink from a supply container 3. The printhead 1 contains a plurality of ink channels (not shown in FIG. 1) which carry ink from the supply container 3 to respective ink ejecting orifices (also not shown in FIG. 1). In use, the carriage 2 reciprocates as indicated by the arrow 2A and droplets of ink are expelled from selected ones of the printhead orifices and are directed towards a recording medium, for example a paper sheet. During each pass of the carriage 2, the sheet 4 is stationary but at the end of each pass it is stepped in the direction of the arrow 4A by action of roller pairs 6A, 6B which frictionally engage the edge of the sheet. For a more detailed explanation of the printhead and the printing process of this embodiment, refer to U.S. Pat. No. 4,571,599 and U.S. Pat. No. Re. 32,572 incorporated herein by reference.

Figure 2A:
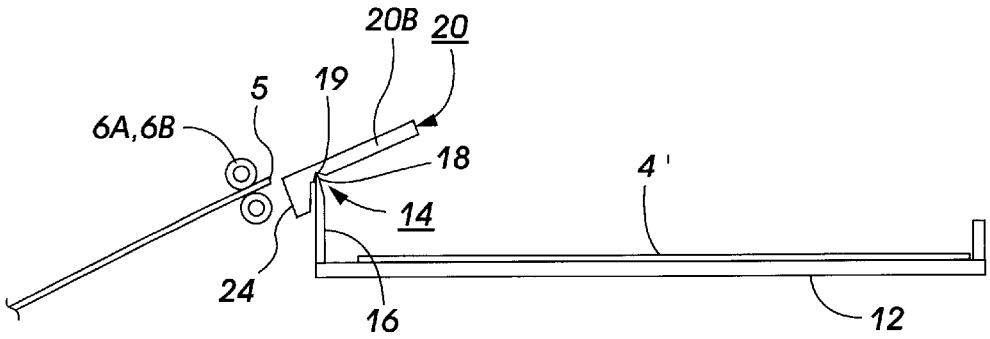
FIG. 2A shows an edge view of the pivoting ramp of the stacking device of FIG. 1 in an unloaded position.
Figure 2B:
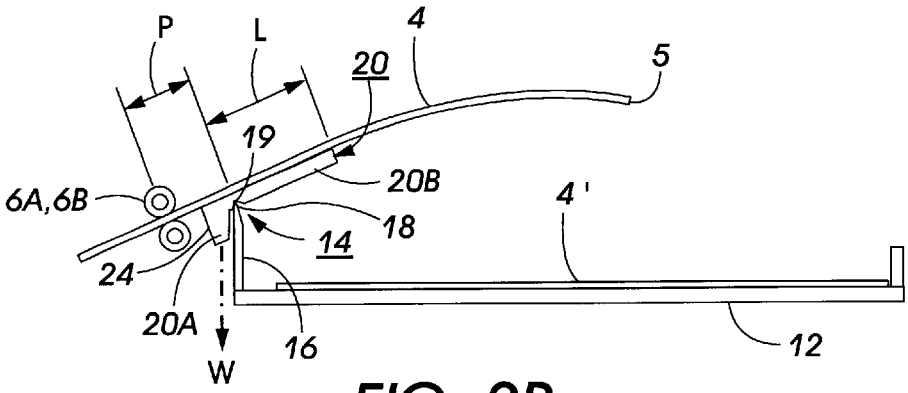
FIG. 2B shows an exiting copy sheet supported by and cantilevered over the ramp.

Of particular interest is the construction and operation of copy sheet stacking apparatus 10. Apparatus 10 comprises a stacking tray 12 in which sheets 4 are ultimately deposited. Referring to FIGS. 1 and 2, attached to the front edge of the tray is a pivoting ramp mechanism 14 which includes a vertical member 16 having a knife edge 18 extending into the page in FIG. 2. Ramp 20 has a pivot notch 22 on its undersurface which cooperates with knife edge 18 to form a balance point 19. The top surface of the ramp forms a support surface for the exiting sheet to move across. The ramp is unbalanced by provision of end segment 20A having a predetermined mass which provides a downward force W shown in FIG. 2A. The pivoting ramp mechanism can be characterized as an articulating paper guide; e.g., having two segments 20A, 20B joined at balance point 19 which controls orientation of the exiting sheet. As shown in FIG. 2B, mechanism 14 is acting as an unbalanced teeter-totter, with a person of weight W sitting on end 24. The ramp directs the lead edge 5 and body of sheet 4 in a trajectory that will prevent sheet 4 from immediately contacting sheets 4' already deposited in tray 12. The ramps articulated structure is designed so that, as trail edge 7 of sheet 4 is released from the exit nip formed at roller pair 6A, 6B, the ramp rotates clockwise, releasing the sheet and allowing it to fall on top of the sheet already in the output tray. It will be appreciated that during the time that the sheet is conveyed along the top surface of the ramp the ink on the previously deposited sheet is drying. Thus, each sheet is deposited on an already dry sheet without the sliding and smearing contact of the prior art mechanisms.

Figure 2C:
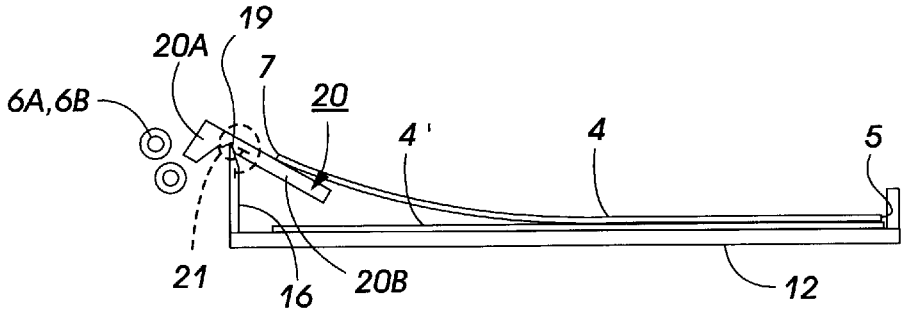
FIG. 2C shows the copy sheet released from the ramp and deposited in the output tray atop a previously deposited sheet.

In a specific embodiment, and referring to FIGS. 2A to 2C, ramp 20 has a total length of 2½ inches with pivot notch 22 a distance P of approximately one-half inch from the exit nip. Sheet 4 is 20# letter size (8½×11) paper, and W is approximately 46 grams. Sheet 4 is conveyed to the pivoting ramp mechanism at an angle of approximately 45° to the vertical member 16. Ramp 20 is inclined at the same angle.

FIG. 2B shows tray 12 with an already deposited sheet 4' and a subsequent copy sheet 4 exiting from the exit nip formed by rollers 6A, 6B. The lead edge 5 of sheet 4 initially contacts the top surface of ramp 20 and slides along the surface extending beyond the ramp edge in cantilevered fashion. At some point, the weight of the paper, as its length extends beyond balance point 19, will trip the balance of the ramp and the ramp will attempt to pivot forward (clockwise). As soon as the trailing edge 7 of sheet 4 clears the exit nip, the ramp pivots to the position shown in FIG. 2C. Again, this occurs because the center mass of the paper is beyond the balance point 19 overcoming weight W. As the ramp pivots forward, the sheet is released, allowing it to glide down and settle on sheet 4'. Once the trail edge 7 slides off and clears the end of ramp 20, the ramp pivots back in a counterclockwise direction to its unloaded position. Optionally, a torsion spring 21 (shown in dotted lines) may be used to assist in returning the ramp to the unloaded position.

Figure 3:
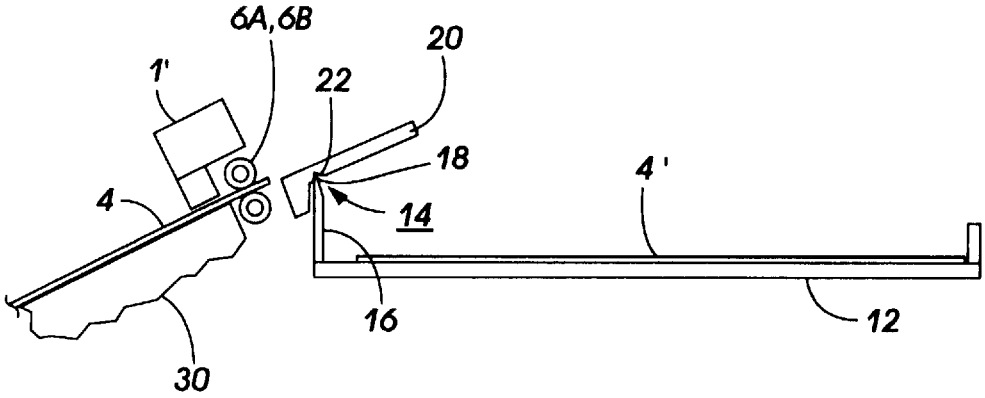
FIG. 3 is a partial side view of a printer with the printhead at an angle to the horizontal.

It is understood that the specific parameters of the pivoting ramp mechanism can vary while still adhering to the principles of the invention. For example, when copy sheet 4 is of a lighter construction, say 16# paper, then W is reduced to about 36 grams. The length L and distance P are also variable, depending upon specific printer design. The angle made by the copy sheet and the ramp can vary from about 90° (horizontal) to about 45°. Thus, referring to FIGS. 2A to 2C, various constructions are possible. The paper could exit along a horizontal plane with the ramp either horizontal or at some angle up to 45°. Or, the sheet could exit the nip at some angle and be conveyed to a horizontal ramp. Also, the specific printer construction can vary from the vertical printhead 1 orientation of FIG. 1 to an angled printhead construction shown in FIG. 3, where the copy sheet is shown advanced along an inclined member past the printhead 1'.

From the above, it will be appreciated that the pivoting ramp structure of the invention is a very low cost and simple method for preventing smeared copy sheets. The print delivery design is enhanced, since the exit tray 12 can be located closer to the exit nip than possible with a stationary (non-pivoting) guide. Further, since the ramp supports the paper sheet, it reduces the tendency of the paper to buckle under the printhead, which can result in print smearing.

While the embodiment disclosed herein is preferred, it will be appreciated from this teaching that various alternative, modifications, variations or improvements therein may be made by those skilled in the art, which are intended to be encompassed by the following claims:

I claim:

1. A copy sheet stacking apparatus for stacking sheets conveyed from a print station, comprising in combination:

a pivoting ramp mechanism including a ramp, a vertical member supporting said ramp at a pivot point whereby said ramp is pivotable about said vertical member, said ramp having a surface for supporting a copy sheet as the sheet emerges from the print station, the surface having a length shorter than a copy sheet length, said ramp further having a first segment and a second segment jointed at said pivot point, said first segment having a weight which provides a downward force W, said force being overcome when a weight of the sheet supported by the ramp surface exceeds W, causing said ramp to rotate about the pivot point and an output tray positioned beneath said ramp whereby the sheet is lowered into the output tray following rotation of the ramp.

2. The apparatus of claim 1 wherein said copy sheet enters said stacking apparatus at an angle between 45° and 90° with respect to said vertical member, and wherein said ramp is inclined at an angle of between 45° and 90° with respect to said vertical member.

3. The apparatus of claim 1 wherein said weight W is approximately 46 grams.

4. The apparatus of claim 1 further including a torsion spring connected to said weighted segment to urge said member to pivot in a counterclockwise direction following release of said sheet into the output tray.

5. The apparatus of claim 1 wherein said ramp has a length which is less than half the length of the copy sheet.

6. A pivoting ramp mechanism for controlling a lead edge trajectory of a copy sheet as the sheet exits a print zone of a printer, the mechanism comprising:

a ramp member having a top and bottom surface, the bottom surface having a notch formed therein to form a pivot point, the ramp comprising a first and second segment joined together at said pivot point, said first segment having a weight W, and a vertical member having an apex seated within said notch whereby said copy sheet is conveyed along the top surface of the ramp, a weight of the copy sheet along said second segment eventually exceeds the weight W causing said ramp pivot clockwise about the pivot causing the sheet to slide off said ramp surface.

7. An ink printer having an improved stacking apparatus comprising:

a supply of copy sheets, means for moving the copy sheets into a print zone, a printhead mounted on a printhead carriage for projecting ink droplets onto one of said copy sheets while in said print zone, means for moving said copy sheet out of said print zone and into a stacking station, the stacking station comprising:

a pivoting ramp mechanism including a ramp, a vertical member supporting said ramp at a pivot point whereby said ramp is pivotable about said vertical member, said ramp having a surface for supporting a copy sheet as the sheet emerges from the print station, the surface having a length shorter than a copy sheet length, said ramp further having a first segment and a second segment jointed at said pivot point, said first segment having a weight which provides a downward force W, said force being overcome when a weight of the sheet supported by the ramp surface exceeds W, causing the ramp to rotate about the pivot point and an output tray positioned beneath said ramp whereby the sheet is lowered into the output tray following rotation of the ramp.

* * * * *